US009829008B2

(12) United States Patent
Bigi et al.

(10) Patent No.: US 9,829,008 B2
(45) Date of Patent: Nov. 28, 2017

(54) CENTRIFUGAL COMPRESSOR IMPELLER COOLING

(71) Applicant: Nuovo Pignone Srl, Florence (IT)

(72) Inventors: Manuele Bigi, Florence (IT); Massimo Camatti, Florence (IT); Bhaskara Kosamana, Bangalore (IN); Rajesh Mavuri, Bangalore (IN); Massimiliano Borghetti, Florence (IT); Rajesh Mamidi, Bangalore (IN)

(73) Assignee: Nuovo Pignone Srl, Florence (IT)

( * ) Notice: Subject to any disclaimer, the term of this patent is extended or adjusted under 35 U.S.C. 154(b) by 277 days.

(21) Appl. No.: 14/409,028

(22) PCT Filed: Jun. 18, 2013

(86) PCT No.: PCT/EP2013/062650

§ 371 (c)(1),
(2) Date: Dec. 18, 2014

(87) PCT Pub. No.: WO2013/189943

PCT Pub. Date: Dec. 27, 2013

(65) Prior Publication Data

US 2015/0240833 A1 Aug. 27, 2015

(30) Foreign Application Priority Data

Jun. 19, 2012 (IT) ..... FI2012A0124

(51) Int. Cl.
*F04D 29/22* (2006.01)
*F04D 29/16* (2006.01)
(Continued)

(52) U.S. Cl.
CPC ..... *F04D 29/2266* (2013.01); *F04D 1/00* (2013.01); *F04D 29/162* (2013.01); *F04D 29/284* (2013.01); *F04D 29/584* (2013.01)

(58) Field of Classification Search
CPC .. F04D 29/2266; F04D 29/162; F04D 29/284; F04D 29/584; F04D 1/00
See application file for complete search history.

(56) References Cited

U.S. PATENT DOCUMENTS 2,658,455 A * 11/1953 Seinfeld ..... F04D 29/2211 415/106
2,694,981 A * 11/1954 Daugherty ..... F04D 29/126 277/348

(Continued)

FOREIGN PATENT DOCUMENTS

CN 1239192 A 12/1999
CN 1878931 A 12/2006

(Continued)

OTHER PUBLICATIONS

Unofficial English Translation of Russian Office Action issued in connection with corresponding RU Application No. 2014149666 dated Aug. 26, 2016.

(Continued)

*Primary Examiner* — Dwayne J White
*Assistant Examiner* — Aaron R Eastman
(74) *Attorney, Agent, or Firm* — GE Global Patent Operation

(57) ABSTRACT

A centrifugal compressor including: a casing; at least one impeller supported for rotation in the casing and provided with a hub, a shroud and an impeller eye; an impeller-eye sealing arrangement, for sealing the impeller in the region of said impeller eye. The centrifugal compressor further includes at least one cooling-medium portlocated at the impeller-eye sealing arrangement, arranged for delivering a cooling medium around the impeller eye.

27 Claims, 4 Drawing Sheets

(51) Int. Cl.

| | |
|---|---|
| ***F04D 29/28*** | (2006.01) |
| ***F04D 29/58*** | (2006.01) |
| ***F04D 1/00*** | (2006.01) |

(56) References Cited

U.S. PATENT DOCUMENTS 3,217,655 A * 11/1965 Sercy ..... F04D 15/00 415/116
3,966,351 A * 6/1976 Sproule ..... F01D 11/04 415/110
4,478,553 A 10/1984 Leibowitz et al.
4,890,980 A * 1/1990 Heald ..... F04D 29/2266 416/181
4,978,278 A * 12/1990 Kun ..... F01D 5/046 277/347
5,297,928 A 3/1994 Imakiire et al.
5,545,008 A * 8/1996 Guelich ..... F04D 29/2272 415/206
6,302,645 B1 * 10/2001 Kobayashi ..... F04D 29/102 415/121.2
6,592,329 B1 * 7/2003 Hirose ..... F04D 29/023 416/203
2011/0058928 A1 * 3/2011 Sheth ..... E21B 43/128 415/1

FOREIGN PATENT DOCUMENTS

| | | | |
|---|---|---|---|
| CN | 102242736 | A | 11/2011 |
| DE | 3926152 | A1 | 1/1991 |
| EP | 0408010 | A1 | 1/1991 |
| JP | 02136598 | A | 5/1990 |
| RU | 47457 | U1 | 8/2005 |
| RU | 2330994 | C2 | 8/2008 |
| SU | 1760178 | A1 | 9/1992 |

OTHER PUBLICATIONS

Italian Search Report issued in connection with Italian application FI2012A000124 dated Mar. 18, 2013.
International Search Report issued in connection with PCT application PCT/EP2013/062650 dated Dec. 20, 2013.
Office Action issued in connection with corresponding CN Application No. 201380032423.5 dated Mar. 28, 2016.
Unofficial English Translation of Chinese Office Action issued in connection with corresponding CN Application No. 201380032423.5 dated Dec. 13, 2016.

* cited by examiner

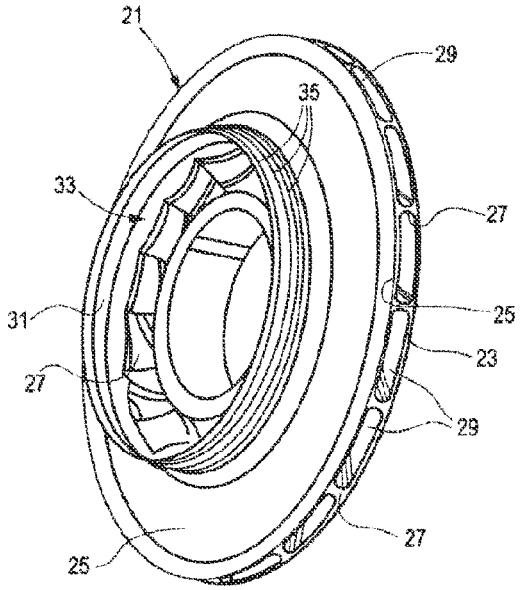
Fig.5
Fig.6
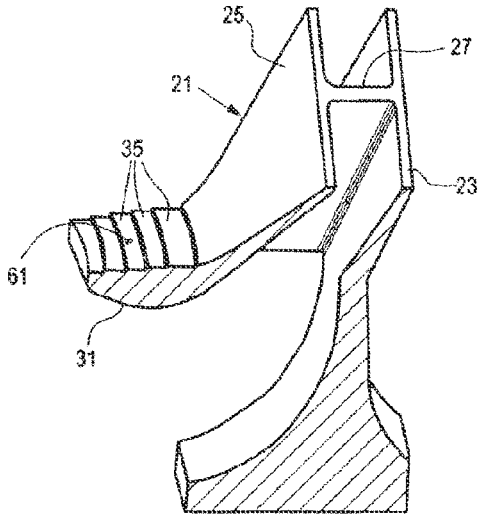
Fig.7
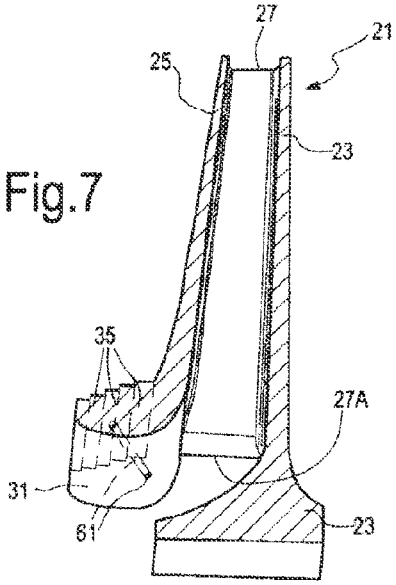

CENTRIFUGAL COMPRESSOR IMPELLER COOLING

FIELD OF THE INVENTION

Embodiments of the present disclosure concern the field of turbo-machineries and in particular, the field of centrifugal compressors.

DESCRIPTION OF THE RELATED ART

Centrifugal compressors are widely used in several industrial fields and are used to process working media of different nature; depending upon the field of application, a high gas pressure can be achieved through one or more stages of a centrifugal compressor. High pressures involve temperature increase of the working medium, which can negatively affect the useful life of the compressor.

In some fields of application a temperature in the range of 650-700° C. or higher can be achieved in the compressor impeller. Creep life of the impeller is critical and is adversely affected by the high temperature of the working medium.

None of the forge or powder metallurgy materials currently used for the manufacturing of shrouded impellers meet the creep life requirement of 60,000 hours. Nickel-based super alloys, such as Inconel 738, meet the requirement of creep life, but the manufacturability and reparability of Inconel impellers are critical.

The above mentioned temperature ranges, material used and creep life requirements are illustrative of one possible application only, and shall not be understood as limiting the scope of application of the present disclosure. A cooling technique as disclosed herein can be used, for instance, also in case of lower temperature ranges, especially if different, less performing and more traditional materials are used.

A multi-stage centrifugal compressor using shrouded impellers according to the state of the art is illustrated in FIG. 1. The centrifugal compressor 100 comprises a casing 102, wherein a rotor shaft 104 is supported. The compressor 100 comprises a compressor inlet 106, a compressor outlet 108 and a plurality of compressor stages, each comprising an impeller 110A-110G. The impellers are arranged serially. The pressure of the working medium is stage-wise increased from the compressor inlet

106 to the compressor outlet 108. The working medium enters each impeller in a substantially axial direction and is delivered radially through a respective diffuser

112 to the next impeller. The temperature of the working medium increases from one stage to the other and can become significant especially in the last stages of the compressor.

SUMMARY OF THE INVENTION

According to some embodiments of the subject matter disclosed herein, a centrifugal compressor assembly is provided, comprising a shrouded impeller, i.e. an impeller with a hub and a shroud, wherein a cooling medium is delivered at the impeller eye, to remove heat from this area of the impeller. The impeller eye is a particularly critical region of the impeller as far as the creep life of the impeller is concerned.

The cooling medium delivered in the region of the impeller eye locally removes heat and keeps the temperature of the impeller eye and of the surrounding are as under a critical value, thus increasing the creep life.

According to some embodiments of the subject matter disclosed herein, a centrifugal compressor assembly is provided, comprising a casing and one or more impellers supported for rotation in the casing, each impeller comprising a hub, a shroud, and an impeller eye. The impeller eye of each impeller is provided with an impeller eye sealing arrangement. At least one cooling medium port is associated to the sealing arrangement, and configured for delivering a cooling medium around the impeller eye. The cooling medium removes heat from the impeller eye and improves the creep life of the impeller.

In some embodiments, a plurality of cooling medium ports is arranged around the impeller eye. In some embodiments, the cooling medium ports are uniformly distributed around the rotation axis of the impeller.

Improved cooling of the impeller eye is achieved by providing a plurality of holes extending from an outer surface of the impeller eye to an inner surface of the impeller eye. At least a portion of the cooling medium flow thus enters the holes and is delivered to the inner part of the shroud. The outlet end of each hole, i.e. the hole aperture on the inner surface of the shroud, can be located near a leading edge of a corresponding impeller blade. By arranging the hole outlet in this position, a particularly efficient cooling of the leading edge of the blade can be obtained.

A source of cooling medium can be provided, for delivering the cooling medium to the cooling medium port or ports provided in one or more compressor stages. In some embodiments, the same working medium flowing through the compressor can be used as a cooling medium for one or more compressor impellers. A portion of the cooling medium flow can be extracted from the main flow, cooled and/or expanded to the required pressure, and then delivered to the impeller eye through one or more cooling medium ports. No separate pumping means will thus be required to bring the cooling medium at the required pressure. Moreover, since the cooling medium is the same working medium flowing through the compressor, the composition of the working medium flow will not be altered by the presence of the cooling medium.

A heat exchanger and a throttling valve can be arranged along a branching-off path, through which a portion of the working medium flow is extracted from the main flow and returned to the compressor. A different pressure-reducing arrangement such as an expander can be used instead of a throttling valve.

The compressor can comprise more than one compressor stage, each provided with an impeller. Some of the impellers can be shrouded, i.e. provided with a shroud and an impeller eye. One or more said shrouded impellers can be combined with a cooling arrangement as described above, i.e. with at least one cooling medium port delivering the cooling medium in the area of the impeller-eye sealing arrangement. Usually, in a multi-stage compressor, the temperature of the working medium be- comes critical only in the last compressor stage(s). In some embodiments, therefore, the cooling arrangement for the impeller eye is provided in at least the last compressor stages.

According to some embodiments, an auxiliary cooling arrangement is provided, for cooling the impeller hub. In some embodiments the impeller hub-cooling arrangement is combined with an impeller eye-cooling arrangement. In other embodiments, only the impeller hub-cooling arrangement is provided. In the last mentioned case, the impeller could also be an open impeller, i.e. not provided with a shroud.

According to a further aspect the subject matter disclosed herein also concerns a method of operating a centrifugal compressor comprising a casing and at least one shrouded impeller rotatingly arranged in the casing, said method providing for injection of cooling medium in a gap around the impeller eye in order to remove heat from the impeller eye region of the impeller.

According to one embodiment, a method of operating a centrifugal compressor is provided, including the following steps: processing a working medium through said impeller; injecting a cooling medium into a gap around said impeller eye and circulating said cooling medium in said gap to cool the impeller eye. The gap can be formed between the impeller eye and an impeller-eye sealing arrangement.

According to some embodiments, the method comprises the step of cooling the impeller eye by using a portion of the working medium processed by the compressor. For example, a sufficient amount of working medium can be extracted from the main flow of compressed working medium and delivered to the area to be cooled inside the compressor casing. Prior to being re-introduced in the compressor casing, the working medium can be cooled and expanded to the required pressure and temperature. A fraction of, e.g., 0.5-5% and more particularly, between 1.0 and 2.5%, of the overall working medium flow can be extracted for cooling purposes.

According to an improved embodiment, the method further comprises the step of injecting or conveying the cooling medium at least partly inside the impeller, between the shroud and the hub. For this purpose, according to some embodiments, the method comprises the steps of: providing at least one hole extending from an outer surface of the impeller eye to an inner surface of the impeller eye, injecting at least part of the cooling medium through the hole.

According to a further aspect, the present disclosure also relates to a method for cooling the hub of an impeller, in combination with cooling of the impeller eye, or independently thereof According to a further aspect, the subject matter disclosed herein refers to an impeller for a centrifugal compressor, comprising an impeller hub and an impeller shroud forming an impeller eye. The impeller eye comprises a radially outer surface and a radially inner surface. At least one hole is provided, extending from the outer surface to the inner surface, the hole being arranged for conveying a cooling medium flow through said impeller eye towards the interior of the shrouded impeller.

According to yet a further aspect, the present disclosure relates to a centrifugal compressor comprising: a compressor casing; at least one impeller supported for rotation in said casing, said impeller comprising a hub with a front wall provided with a plurality of impeller blades and a rear wall, extending mainly radially; a space between the rear wall of the impeller and the compressor casing; at least one cooling medium port, configured and arranged for delivering a cooling medium in said space; said space being in fluid communication with a compressor diffuser at the outlet of the compressor impeller; wherein a cooling medium delivered in the space between the compressor casing and the rear wall of the impeller flows in said diffuser. In some embodiments, the cooling medium is delivered in a gap formed between a sealing arrangement and an axial rotary component, which rotates with the impeller, e.g. the shaft on which the impeller is torsionally engaged, or a balance drum arranged at the rear side of the impeller. The pressure of the cooling medium and the sealing arrangement can be such that the cooling medium flows from the gap formed by the sealing arrangement and the axial rotary component, partly in the space between the rear wall of the impeller and the compressor casing, and partly in the opposite direction, towards the rear of the compressor casing.

The above described arrangement can be used to perform a method of operating a centrifugal compressor, wherein cooling medium is delivered in the gap between the sealing arrangement and the axial rotary component, e.g. the impeller shaft or the balance drum; and wherein the cooling medium flow is partly delivered in the space at the rear of the impeller and from there in the diffuser, and partly on the opposite side of the sealing arrangement, towards the back of the compressor. Also in this case the cooling medium can be a portion or fraction of the working medium processed by the compressor, which is suitably cooled and partly expanded, if needed, before being delivered in the sealing arrangement at the rear side of the impeller. In some embodiments approximately 1.5 to 2.5% by volume of the main working medium flow can be diverted for the purpose of cooling the rear side of the impeller.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIG. 5 illustrates a perspective view of a shrouded impeller for a centrifugal compressor of FIGS. 4; and FIGS. 6 and 7 illustrate fragmentary perspective views of a portion of a shrouded impeller in an improved embodiment of the subject matter of the present disclosure.

DETAILED DESCRIPTION OF EMBODIMENTS OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
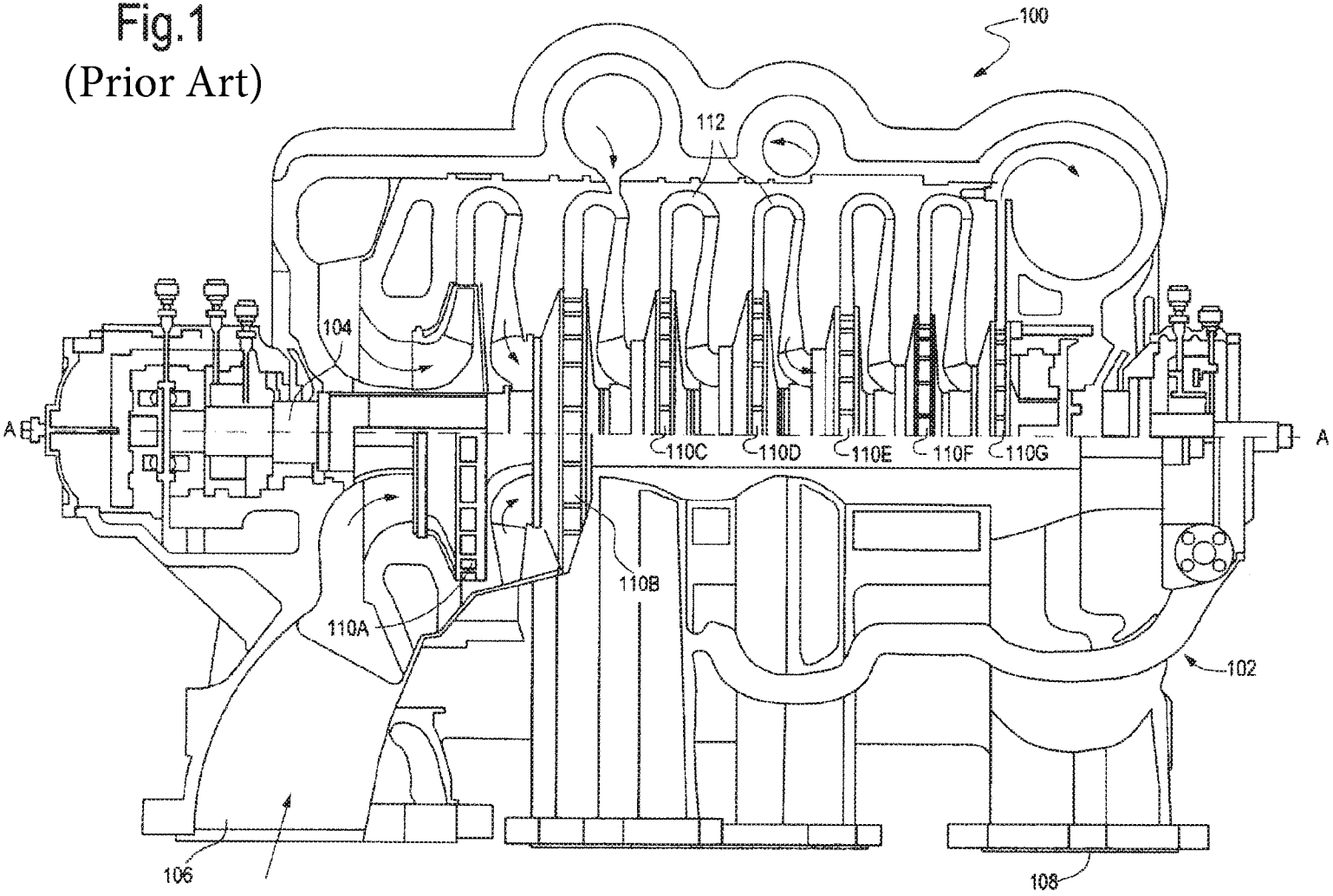
Fig.1 (Prior Art)
FIG. 1 illustrates a longitudinal section according to a vertical plane of a multi-stage centrifugal compressor of the prior art.
Figure 2:
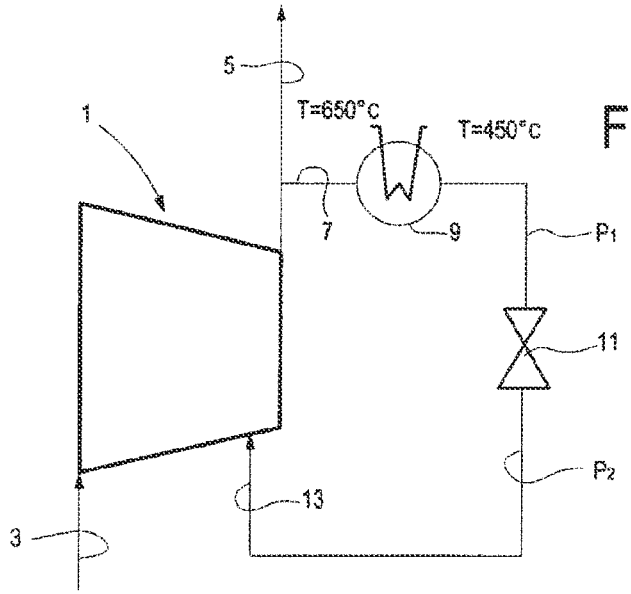
FIG. 2 diagrammatically illustrates a compressor with a cooling system in a first embodiment of the subject matter disclosed herein.

FIG. 2 schematically illustrates a compressor assembly according to the present disclosure. In the diagrammatic representation of FIG. 2 a centrifugal compressor, designated 1 as a whole, is schematically represented. The centrifugal compressor 1 can comprise one or more compressor stages, each stage comprising one impeller similarly to the compressor 100 illustrated in FIG. 1. The working medium, for example air or any other gaseous medium, enters the compressor 1 at a compressor inlet 3 and exits the compressor 1 at a compressor outlet 5. As schematically represented in FIG. 2, a portion of the working medium flowing through the compressor outlet 5 is extracted and diverted along a duct 7 through a heat exchanger 9, wherein the portion of the diverted compressed working medium is cooled. The heat exchanger 9 can be a gas/air or gas/water heat exchanger, for example. The cooled working medium can then flow through a pressure reducing member, e.g. a throttling valve 11, and introduced again in one or more compressor stages through a duct 13. In other embodiments the pressure reducing member can be an expander.

The pressure of the working medium flowing through the throttling valve 11 is reduced from a higher pressure P1 to a lower pressure P2. The pressure drop across the throttling valve 11 depends upon the pressure of the fluid at the compressor outlet and the pressure of the fluid in the point where the cooled working medium is reinjected in the compressor. In other embodiments, not shown, the working medium can be diverted from the main flow at a different location along the working medium path, e.g. at the outlet of an intermediate compressor stage.

In some possible applications the working medium is air and the temperature of the air at the compressor outlet 5 can be around 650° C., while the temperature of the working medium at the outlet of the heat exchanger 9 can be around 450° C. These values are given by way of example only, and they should not be construed as limiting the scope of the present disclosure. A further temperature reduction can be achieved when the working medium flows through the throttling valve 11. In some embodiments, sufficient cooling could be achieved by throttling only, or by heat exchange only.

Figure 3:
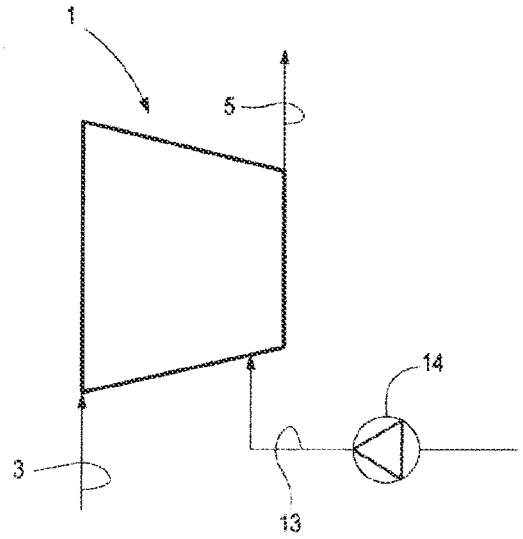
FIG. 3 illustrates the diagrammatic representation of a different embodiment of the subject matter present disclosure.

A modified embodiment of the compressor assembly is shown in FIG. 3. The same reference numbers indicate the same or equivalent parts as in FIG. 2. In this embodiment, the cooling medium is not represented by a part of working medium diverted at the outlet of the compressor, but is delivered from a separate source, not shown. A compression device 14 can be provided to pump the cooling medium at the required pressure, depending upon the operating pressure of the compressor into which the cooling medium is to be injected.

The embodiment of FIG. 2 does not require a separate pumping arrangement, even though the extraction of part of the working medium for cooling purposes reduces the overall efficiency of the compressor.

The schematic layouts shown in FIGS. 2 and 3 are by way of example only, and it shall be understood that different arrangements can be provided, e.g. as far as the cooling medium source is concerned, or as far as the cooling of the fluid and/or the expansion thereof is concerned.

The cooling medium flowing through the duct 13 and injected in the compressor is used for cooling some areas of one or more impellers of the compressor 1, as will be disclosed below, reference being made in particular to FIGS. 4 to 7. In the following description of the exemplary embodiment, reference will be made to an implementation according to FIG. 2, i.e. wherein a part of the working medium is used as a cooling medium, by diverting it from the main flow and re-introducing it in the compressor at a suitable temperature and pressure. However, as noted above, the cooling medium could be provided by an external source.

Referring to FIGS. 4 to 7, reference will be made to the last compressor stage of a multi-stage centrifugal compressor. It shall be understood that the same features which will be described in connection with the impeller of the last compressor stage can be provided also in additional stages of the multi-stage compressor. It should further be understood that the features disclosed herein with respect to a multi-stage compressor can be implemented also in a single-stage compressor, if required.

Figure 4:
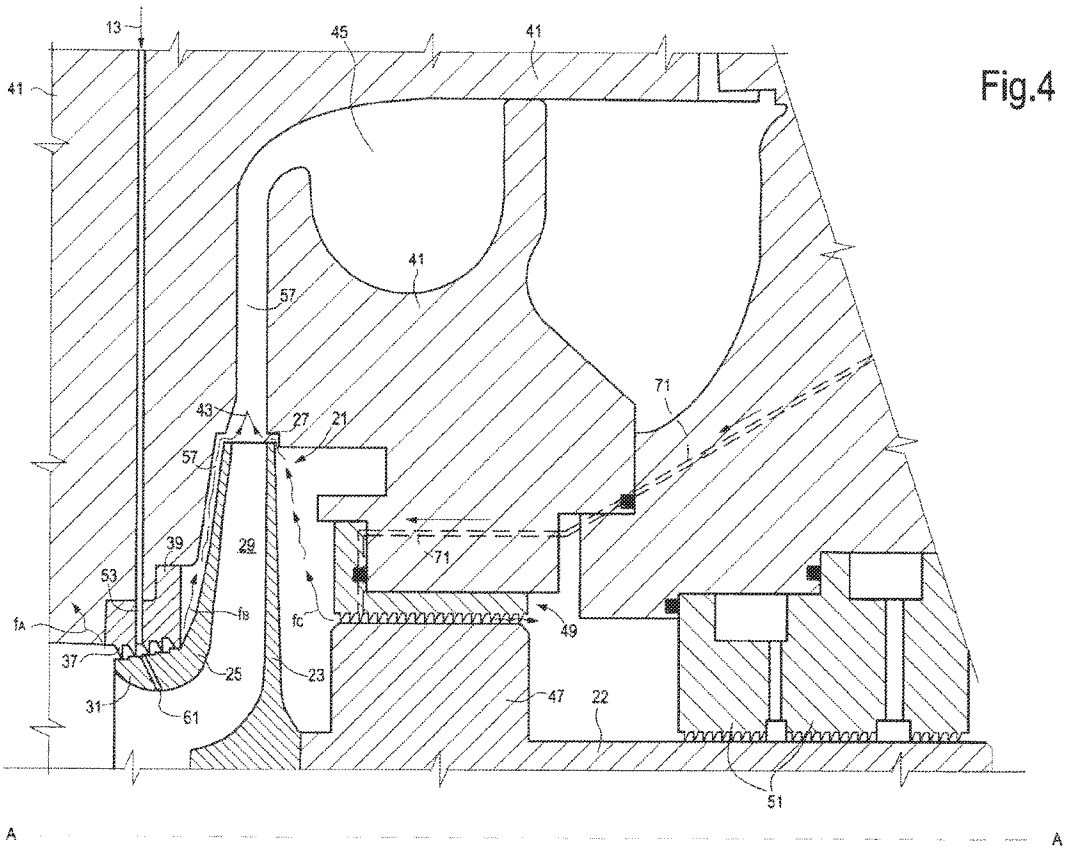
FIG. 4 illustrates longitudinal section of a compressor stage with an impeller eye-cooling system in combination with a hub-cooling system according to an embodiment of the present disclosure.

In FIG. 4 a portion of the compressor 1 is shown in a vertical section along a plane containing the axis A-A of the compressor rotor. The last compressor stage comprises an impeller 21 supported by a rotary shaft 22. The impeller is shown in isolation in FIG. 5. In the embodiment disclosed herein the impeller 21 comprises an impeller hub 23 and an impeller shroud 25. Blades 27 extend radially between the impeller hub 23 and the impeller shroud 25 forming impeller vanes 29 therebetween. The impeller shroud 25 comprises an impeller eye 31 extending around an impeller inlet 33.

The impeller eye 31 can be provided with external annular teeth 35, cooperating with sealing lips 37 of an impeller-eye sealing arrangement 39 mounted in the compressor casing 41. The impeller-eye sealing arrangement 39 provides a sealing between the compressor stage containing the impeller 21 and the upstream compressor stage (not shown).

The working medium processed by the impeller 21 is discharged radially from the vanes 29 in a diffuser 43 formed in the casing 41 and enters a volute 45 which is in fluid communication with the compressor outlet 5.

A balance drum 47 is arranged behind the hub 23, i.e. on the side of the impeller 21 opposite the impeller eye 31. The balance drum 47 co-acts with a sealing arrangement 49, which seals the space where the impeller 21 is housed against the rear part of the compressor. In the diagrammatic section of FIG. 4 further sealing arrangements 51 co-acting with the rotary shaft 22 are also shown.

In some embodiments one or more cooling medium ports 53 are arranged around the impeller eye 31. The cooling medium ports 53 are in fluid communication with the duct 13, through which the portion of suitably cooled working medium, extracted from the main compressor outlet 5, is re-introduced in the compressor casing, for cooling the impeller eye 31. In some embodiments a plurality of cooling medium ports 53 are uniformly arranged around the annular development of the impeller-eye sealing arrangement 39. For example, from 2 to 20 ports 53 can be provided. In some embodiments, between 8 and 15, and more particularly, between 10 and 14, cooling medium ports 53 can be provided. Through the cooling medium ports 53 a percentage of e.g. around 2% of the total outlet working medium flow exiting the compressor can be re-introduced in the compressor casing.

The cooling medium flowing through each cooling medium port 53 enters the gap between the sealing lips 37 of the impeller-eye sealing arrangement 39 and the impeller eye 31. The cooling medium delivered through the cooling medium ports 53 has a pressure which is higher that the inlet pressure of the relevant compressor stage. For example, if the working medium pressure at the impeller inlet is around 55 Bars, the cooling medium can be delivered at around 60 Bars through the cooling medium ports 53. Consequently, the cooling medium will be forced to escape the gap between the lips 37 and the impeller eye 31. A fraction of the cooling medium will escape the gap according to arrow fA and another part of the cooling medium flow will escape the gap along arrow fB. The first part of the cooling medium, for example around 1.2 to 1.3% of the total working medium flowing through the compressor, will escape according to arrow fA and enter the upstream compressor stage, while the remaining part will flow along the outer surface of the shroud 25 of the impeller 21 along a gap 57 between the compressor casing 41 and the impeller shroud 25, finally entering the diffuser 43.

The cooling-medium flow cools the outer surface of the impeller eye 31. The temperature of the impeller eye region, which is subject to particularly high mechanical stresses, will thus be reduced, thereby improving the creep life of the impeller.

According to a further improvement of the subject matter disclosed herein, the impeller eye 31 is provided with a plurality of holes 61. In some embodiments at least one hole is provided for each blade 27. A clear illustration of one such hole is provided in FIGS. 6 and 7. These figures show a cross section of a portion of the impeller 21. In these figures a fragment of the impeller eye 31, of the hub 23 and of the shroud 25, as well as one of the blades 27 are shown. Each hole 61 extends from an inlet on the outer surface of the impeller eye 31 to an outlet on the inner surface of the impeller eye 31. In some embodiments, as shown in FIGS. 6 and 7, the hole 61 opens on the inner surface of the impeller eye 61 approximately in front of the leading edge 27A of a corresponding blade 27.

With this arrangement at least part of the cooling medium delivered through the cooling medium ports 53 enters the holes 61. Each hole 61 generates a cooling medium flow, which flows along both sides of the respective blade 27. The cooling medium flow removes heat from the blade leading edge and the area where the blade 27 is connected to the impeller eye 31. This area is subject to high thermal and mechanical stresses. Removal of heat from this area reduces the temperature and alleviates creep, thus further increasing the creep life of the impeller.

In some embodiments, additional reduction of overheating and creep problems can be achieved by providing a cooling medium flow also in the area of the hub 23.

This is schematically shown in FIG. 4. One or more auxiliary ports 71 can be provided, which connect the duct 13 to the sealing arrangement 49. A fraction of the working medium, extracted from the compressor outlet 5, cooled in the heat exchanger 9 and expanded in the throttling valve 11, flows through the ports 71 into the gap between the sealing arrangement 49 and the balance drum 47. This cooling medium flow escapes the gap between the sealing arrangement 49 and the balance drum 47 and at least part of said flow enters the space between the stationary parts of the compressor casing 41 and the rear wall of the impeller 21 according to arrow fC. This part of the cooling medium flow will finally enter the diffusor 43. In some embodiments, the cooling medium delivered in the gap between the sealing arrangement 49 and the balance drum 47 can be approximately 2.0-2.2% of the overall compressor outlet flow and approximately ⅓ of this cooling medium flow will enter the space behind the impeller 23 and finally reach the diffusor 57, while the remaining part will escape the gap between the sealing arrangement 49 and the balance drum 47 at the opposite side.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. A centrifugal compressor comprising:

a casing;

at least one impeller supported for rotation in the casing, the at least one impeller comprising a hub, a shroud, and an impeller eye comprising an inner surface, an outer surface, external annular teeth formed on a portion of the outer surface, and at least one hole extending from the portion of the outer surface on which the external annular teeth have formed to the inner surface;

an impeller-eye sealing arrangement disposed over the external annular teeth for sealing the at least one impeller in a region of the impeller eye;

at least one cooling medium port located at the impeller-eye sealing arrangement, configured to deliver a cooling medium around the impeller eye.

2. The centrifugal compressor according to claim 1, further comprising at least one hole for each one of a plurality of blades provided between the hub and the shroud.

3. The centrifugal compressor according to claim 1, wherein the at least one cooling medium port is in fluid communication with a delivery duct of the compressor, through which a main stream of a working medium is caused to flow, a portion of the working medium being extracted from the main stream in the delivery duct and diverted towards the at least one cooling-medium port.

4. The centrifugal compressor according to claim 3, further comprising a heat exchanger, through which the portion of the working medium is cooled before being delivered to the cooling-medium port.

5. The centrifugal compressor according to claim 3, further comprising a pressure reducing arrangement, for reducing a pressure of the portion of the working medium, before being delivered to the cooling medium port.

6. The centrifugal compressor according to claim 1, further comprising a plurality of sequentially arranged compressor stages, each compressor stage comprising a respective impeller, at least one of the impellers being combined with the impeller-eye sealing arrangement and with the at least one cooling medium port.

7. The centrifugal compressor according to claim 1, further comprising at least one auxiliary cooling medium port configured to deliver an auxiliary cooling medium flow behind the hub of the at least one impeller.

8. The centrifugal compressor according to claim 7, further comprising a rotating shaft supporting the at least one impeller and a balance drum, the balance drum co-acting with a balance-drum sealing arrangement, and wherein the at least one auxiliary cooling medium port is configured to deliver the auxiliary cooling medium flow between the balance drum and the balance-drum sealing arrangement.

9. The centrifugal compressor according to claim 7, wherein the at least one auxiliary cooling medium port is in fluid communication with a delivery duct of the compressor, through which a main stream of a working medium is caused to flow, a portion of the working medium being extracted from the main stream in the delivery duct and diverted towards the at least one auxiliary cooling medium port.

10. A method of operating a centrifugal compressor comprising a casing and at least one impeller rotatingly arranged in the casing, the at least one impeller comprising an impeller hub, an impeller shroud, and an impeller eye comprising an inner surface, an outer surface, external annular teeth formed on a portion of the outer surface, and at least one hole extending from the portion of the outer surface on which the external annular teeth are formed to the inner surface; the method comprising:

processing a working medium through the impeller;

injecting a cooling medium into a gap around the impeller eye and circulating the cooling medium in the gap, for removing heat from the impeller eye; and delivering at least part of the cooling medium through the at least one hole towards the inner surface.

11. The method according to claim 10, wherein the gap is formed between the impeller eye and an impeller-eye sealing arrangement.

12. The method according to claim 10, wherein the cooling medium is a portion of the working medium.

13. The method according to claim 10, further comprising extracting a portion of the working medium as cooling medium.

14. The method according to claim 13, wherein a percentage from 0.5 to about 4% in volume of the working medium is extracted to cool the impeller eye.

15. The method according to claim 10, further comprising removing heat from the portion of the working medium before injecting into the gap.

16. The method according to claim 10, further comprising reducing the pressure of the portion of the working medium before injecting into the gap.

17. The method according to claim 10, further comprising delivering the cooling medium at least partly between the impeller shroud and the impeller hub.

18. The method according to claim 10, further comprising cooling the impeller hub by delivering a portion of the cooling medium behind the impeller hub.

19. The method according to claim 10, comprising:

extracting a portion of the working medium as the cooling medium;

injecting a first fraction of the portion of working medium in the gap around the impeller eye for cooling the impeller shroud;

injecting a second fraction of the portion of working medium behind the impeller hub for cooling the impeller hub.

20. The method according to claim 10, wherein a percentage from 0.5 and 4% in volume of the working medium is extracted to cool the hub.

21. An impeller for a centrifugal compressor, the impeller comprising;

an impeller hub and an impeller shroud forming an impeller eye, the impeller eye comprising a radially outer surface, a radially inner surface, external annular teeth formed on a portion of the radially outer surface, and at least one hole provided, extending from the portion of the radially outer surface on which the external annular teeth are formed to the radially inner surface, the at least one hole being arranged for conveying a cooling medium flow through the impeller eye.

22. The impeller according to claim 21, wherein the impeller eye comprises a plurality of the at least one hole.

23. The impeller according to claim 21, wherein the impeller eye further comprises at least one hole for each one of a plurality of blades arranged between the impeller shroud and the impeller hub.

24. The impeller according to claim 21, wherein each hole of the at least one hole has a hole outlet on the inner surface arranged substantially in front of a leading edge of the respective blade.

25. A centrifugal compressor comprising:

a compressor casing;

at least one impeller supported for rotation in the casing, the impeller comprising a hub with a front wall provided with a plurality of impeller blades, and a rear wall extending mainly radially, a shroud, and an impeller eye comprising an inner surface, an outer surface, external annular teeth formed on a portion of the outer surface, and at least one hole extending from the portion of the outer surface on which the external annular teeth are formed to the inner surface, wherein the at least one hole is configured to deliver a cooling medium to the inner surface:

a space between the rear wall of the impeller and the compressor casing; and at least one cooling medium port, configured and arranged for delivering the cooling medium in the space, wherein the space is in fluid communication with a compressor diffuser at the outlet of the compressor impeller, and the cooling medium is delivered in the space between the compressor casing and the rear wall of the impeller flows in the diffuser.

26. The centrifugal compressor according to claim 25, wherein the cooling medium port is configured to deliver the cooling medium in a gap formed between a sealing arrangement and an axial rotary component, which rotates with the impeller, and wherein pressure of the cooling medium and the sealing arrangement are such that the cooling medium flows from the gap formed by the sealing arrangement and the axial rotary component, partly in the space between the rear wall of the impeller and the compressor casing, and partly in the opposite direction, towards the rear of the compressor casing.

27. The centrifugal compressor according to claim 25, wherein the axial rotary component is a balance drum arranged at the rear side of the impeller.

* * * * *